US012379162B2

(12) United States Patent
Li

(10) Patent No.: US 12,379,162 B2
(45) Date of Patent: Aug. 5, 2025

(54) HEAT DISSIPATION MESH FOR COOLING TOWER

(71) Applicant: Yu-Sung Li, Chiayi County (TW)

(72) Inventor: Yu-Sung Li, Chiayi County (TW)

(73) Assignees: Yu-Sung Li, Chiayi County (TW); WishTech Co., Ltd., Tainan (TW)

( * ) Notice: Subject to any disclaimer, the term of this patent is extended or adjusted under 35 U.S.C. 154(b) by 284 days.

(21) Appl. No.: 18/125,735

(22) Filed: Mar. 24, 2023

(65) Prior Publication Data

US 2024/0318917 A1 Sep. 26, 2024

(51) Int. Cl.
*F28C 1/14* (2006.01)

(52) U.S. Cl.
CPC ..... *F28C 1/14* (2013.01)

(58) Field of Classification Search
CPC ..... F28C 1/00; F28C 1/14; F28F 3/083; F28F 2275/085; F28F 2280/04
USPC ..... 261/112.2
See application file for complete search history.

(56) References Cited

U.S. PATENT DOCUMENTS 3,260,511 A * 7/1966 Greer ..... F28F 25/087 52/783.17
4,361,426 A * 11/1982 Carter ..... F28F 25/087 55/440
4,477,394 A * 10/1984 Armstrong ..... F28F 25/085 411/908
4,728,468 A * 3/1988 Duke ..... F28F 25/085 52/581
5,017,309 A * 5/1991 Peterson ..... F28F 25/085 261/111
5,474,832 A * 12/1995 Massey ..... F28F 25/087 428/184
6,096,407 A * 8/2000 Vodicka ..... B01J 19/32 428/184
8,834,058 B2 * 9/2014 Woicke ..... F28F 25/08 403/252
9,555,390 B2 * 1/2017 Krell ..... B01J 19/32
11,293,705 B2 * 4/2022 Kulick, III ..... F28F 25/087
(Continued)

FOREIGN PATENT DOCUMENTS

DE 19733480 A1 * 2/1999

OTHER PUBLICATIONS

English Machine Translation of DE 19733480 A1 (Year: 1999).*

*Primary Examiner* — Charles S Bushey

(57) ABSTRACT

A heat dissipation mesh for a cooling tower, including a plurality of ribs arranged in a mesh configuration. Each rib on one end of the heat dissipation mesh has a plurality of side male snap-fits, and each rib on the other end of the heat dissipation mesh has a plurality of side female snap-fits. The side male snap-fits and side female snap-fits can be snap-fitted to each other. Multiple heat dissipation meshes can be connected together by snapping the side male snap-fits and side female snap-fits of adjacent meshes together. This allows for the total length to be extended or shortened as needed, thus addressing problems with adjusting the size and difficulty of maintenance commonly found in existing products. The ribs may be arranged in a trapezoidal wave-form and may have stackable snap-fits for additional flex-ibility. The material used for the heat dissipation mesh includes properties of non-stickiness and antibacterial.

9 Claims, 10 Drawing Sheets

(56) References Cited

U.S. PATENT DOCUMENTS

2005/0001338 A1* 1/2005 Hagemann ..... F28F 21/067
261/DIG. 11

* cited by examiner

HEAT DISSIPATION MESH FOR COOLING TOWER

BACKGROUND OF INVENTION

Field of the Invention

The present invention relates to a heat dissipation mesh for a cooling tower, also known as a heat dissipation fill or heat dissipation plate, which is filled into the cooling tower to achieve efficient heat dissipation.

Description of Related Art

A cooling tower is a necessary component in a water-cooling system. In such a system, cooling water circulates through equipment requiring cooling and absorbs the heat generated by the machinery. As a result, the temperature of the cooling water rises. The heated cooling water then enters the cooling tower, where its temperature is lowered before it is recirculated to the machinery for further cooling.

The typical cooling tower usually dissipates heat through equipment such as heat sinks and cooling fans. The heat sinks are generally located below the outlet and have the ability to prolong the stagnation time of the water flow, increase the heat exchange surface area, and enhance the heat exchange effect with the outside air. Additionally, the heat sinks facilitate even water flow towards the lower collection area.

Although heat sinks are a commonly used product, there are some issues with the current ones available on the market. Take a cylindrical cooling tower as an example; the heat sink pattern used is a long strip of heat sink rolled into a cylindrical shape. However, the reusability of this type of heat sink is extremely low. For example, when replacing a larger cooling tower, the original heat sink cannot be reused, or if only a portion of the heat sink is damaged, the entire roll of heat sink must be discarded, which is quite wasteful.

In view of the aforementioned problems, it is necessary to improve the current product in terms of difficulty in adjusting the size of use and inconvenient maintenance.

SUMMARY OF THE INVENTION

The heat dissipation mesh of the present invention is designed with a plurality of side male snap-fits and side female snap-fits on both sides, and each side male snap-fit and side female snap-fit can be snap-fitted to each other, allowing multiple heat dissipation meshes to be used together by simply snapping the side male snap-fits and side female snap-fits of adjacent meshes together to extend the total length. By removing the connected heat dissipation meshes, the total length can be reduced. In other words, users can easily adjust the joint of heat dissipation meshes according to their needs and adapt to the internal space of various cooling towers. When maintenance is required, only the damaged heat dissipation mesh needs to be removed. The present invention effectively solves the problems of difficulty in adjusting the size and inconvenience in maintenance of conventional products.

To achieve the above objectives and effects, the present invention provides a heat dissipation mesh for a cooling tower, comprising a plurality of ribs arranged in a mesh configuration; wherein each rib on one end of the heat dissipation mesh has a plurality of side male snap-fits and each rib on another end of the heat dissipation has a plurality of side female snap-fits, such that the side male snap-fits and the side female snap-fits can be snap-fitted to each other.

More particularly, wherein each rib is arranged in a trapezoidal waveform, such that the heat dissipation mesh has a first peak side and a second peak side.

More particularly, wherein each side male snap-fit and each side female snap-fit are disposed on the rib located at the same peak side of the first peak side and the second peak side.

More particularly, wherein each rib is respectively arranged in a triangle and a rectangle pattern to form grids for the mesh configuration.

More particularly, wherein each rib is in a semi-elliptical shape.

More particularly, wherein a plurality of stackable female snap-fits and male snap-fits are distributed on each rib except for the ribs on both sides of the heat dissipation mesh, and each stackable male snap-fit and each stackable female snap-fit can be snap-fitted to each other.

More particularly, wherein each stackable male snap-fit is provided on one of the ribs located at the first peak side or the second peak side, and each stackable female snap-fit is provided on another one of the ribs located at the first peak side or the second peak side.

More particularly, wherein the material used for the heat dissipation mesh includes properties of non-stickiness and antibacterial.

More particularly, wherein each side male snap-fit includes a circular portion; a plurality of claw ribs extending towards a center from the circular portion; a snap body connected with one end of each snap head; and a snap head connected with one end of the snap body, and the width diameter of the snap head is greater than that of the connected snap body; a plurality of grooves penetrating each connected snap head and snap body, each claw rib partially located in the corresponding groove, and each side female snap-fit has a circular ring shape.

DETAILED DESCRIPTION OF EMBODIMENTS

Figure 1:
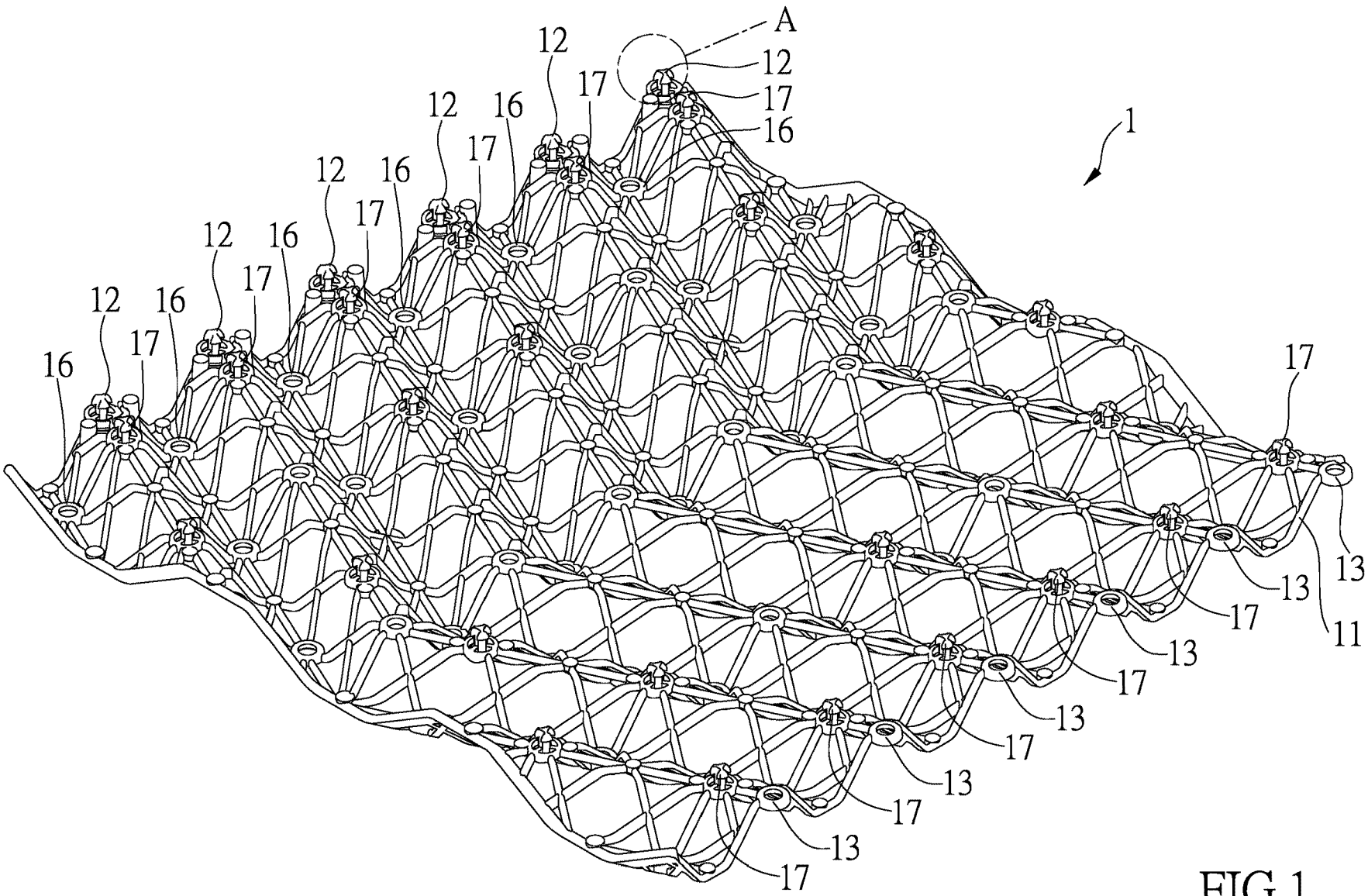
FIG. 1 is a three-dimensional view of the present invention.

To better understand the embodiments of the present invention, please refer to the accompanying drawings, as shown in FIGS. 1-6. The present invention provides a heat dissipation mesh 1 for a cooling tower, comprising a plurality of ribs 11 arranged in a mesh configuration, wherein each rib 11 on one end of the heat dissipation mesh 1 has a plurality of side male snap-fits 12 and each rib 11 on another end of the heat dissipation 1 has a plurality of side female snap-fits 13, such that the side male snap-fits 12 and the side female snap-fits 13 can be snap-fitted to each other.

Figure 5:
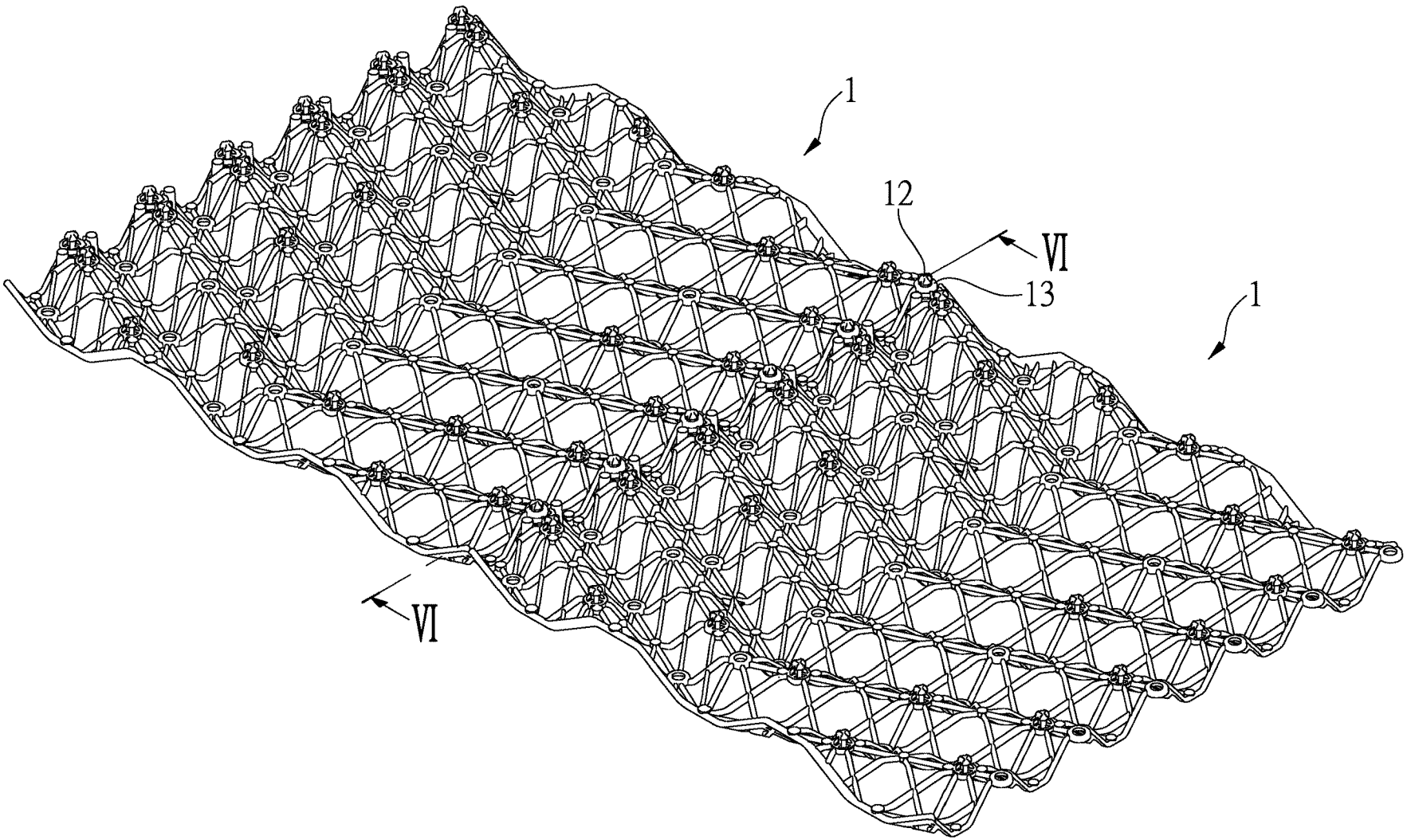
FIG. 5 is a schematic diagram of two connected heat dissipation meshes.

To further describe the embodiments of the present invention, The heat dissipation mesh 1 of the present invention is designed with a plurality of side male snap-fits 12 and side female snap-fits 13 on both sides, such that the side male snap-fits 12 and side female snap-fits 13 can be snap-fitted to each other. By utilizing this structural feature, when using multiple heat dissipation meshes 1, it is only necessary to snap-fit the side male snap-fits 12 and side female snap-fits 13 of adjacent heat dissipation meshes 1 together, as shown in FIG. 5, to achieve an extension of the total length. And, by removing the connected heat dissipation mesh 1, the total length can be shortened. In other words, users can easily adapt to the internal space of various cooling towers by reducing or increasing the connection of heat dissipation meshes 1 according to their needs, and only need to remove the damaged heat dissipation mesh 1 during maintenance. The present invention indeed improves the problems of difficulty in adjusting the size and inconvenience in maintenance commonly found in conventional products.

Figure 3:
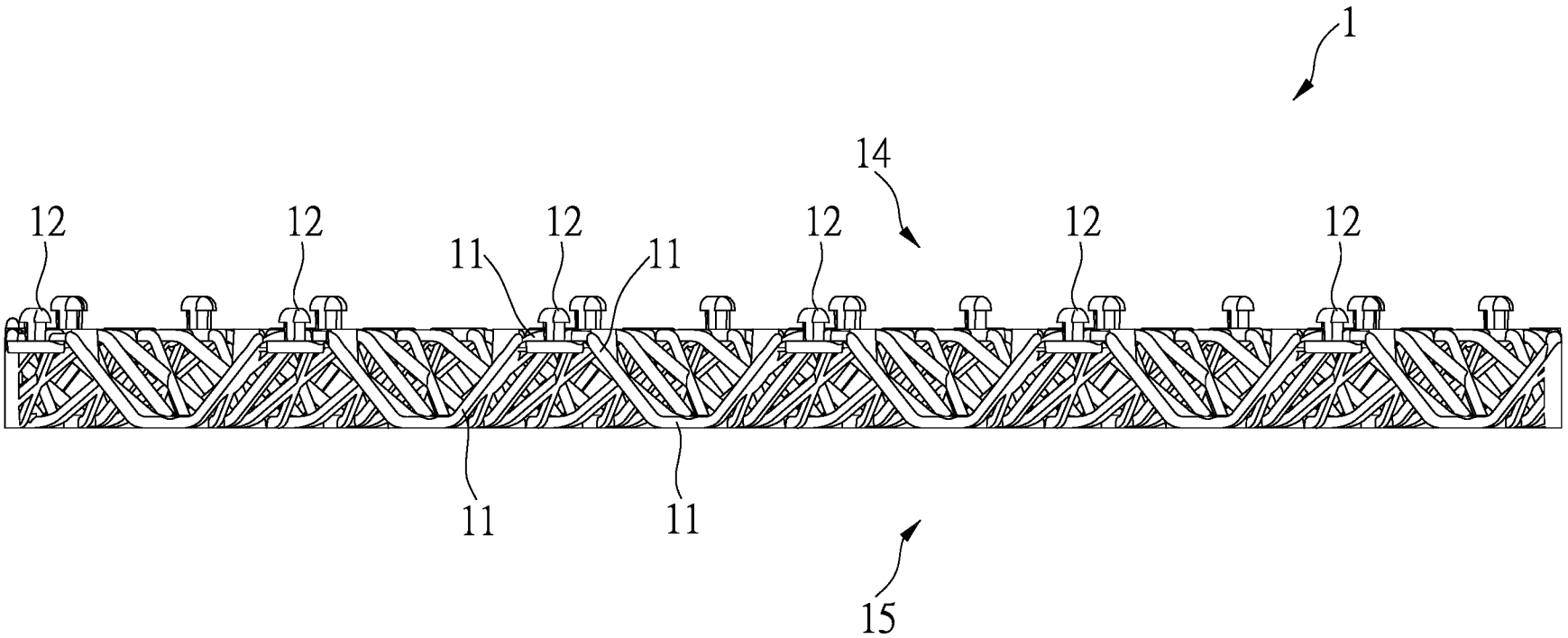
FIG. 3 is a plan view of the present invention with side male snap-fits on one end.
Figure 4:
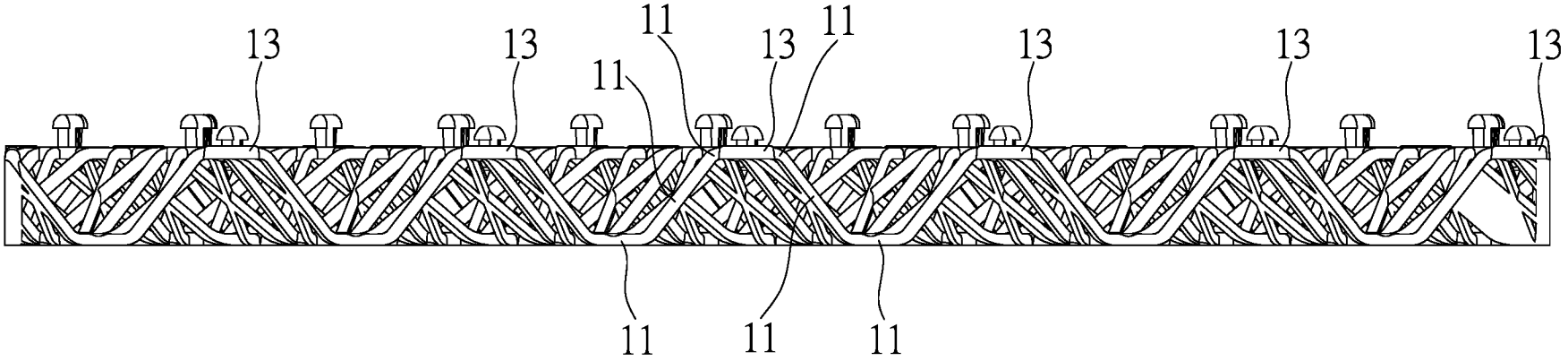
FIG. 4 is a plan view of the present invention with side female snap-fits on one end.

As shown in FIGS. 3 and 4, each rib 11 is arranged in a trapezoidal waveform, such that the heat dissipation mesh 1 has a first peak side 14 and a second peak side 15. The trapezoidal waveform of each rib 11 significantly improves heat dissipation performance and reduces susceptibility to fouling.

Figure 6:
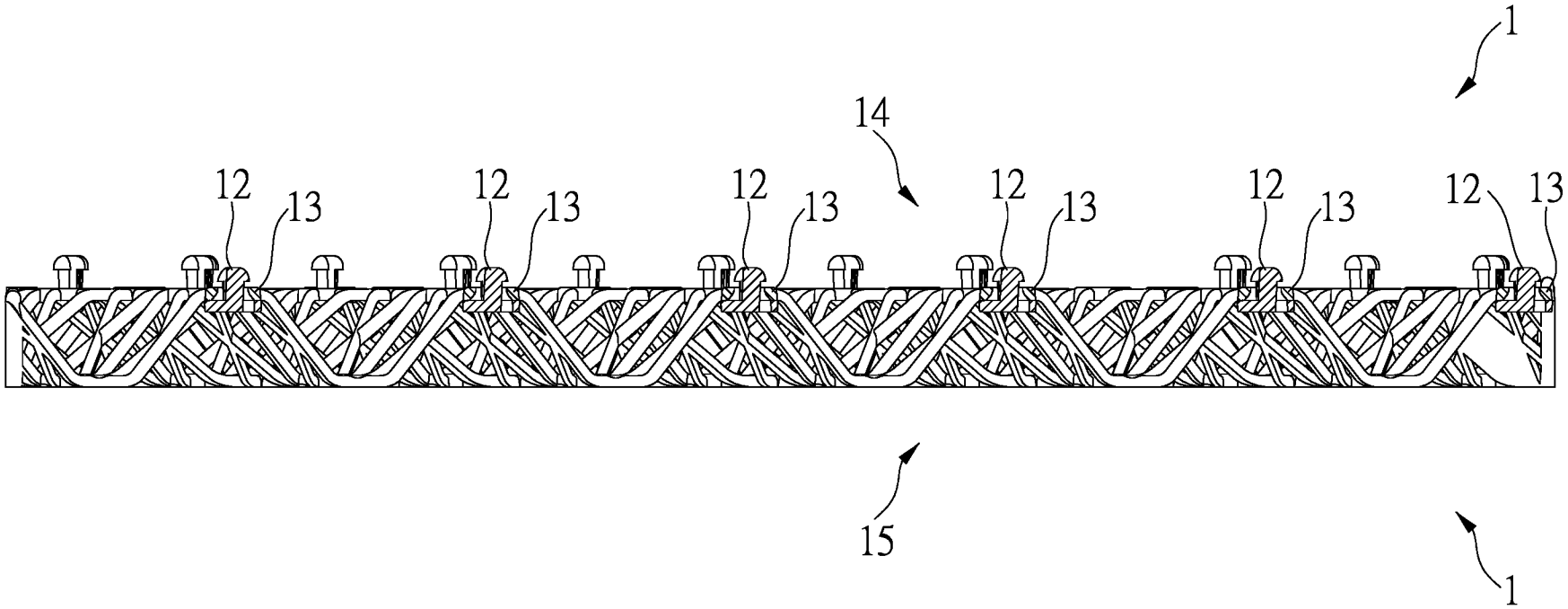
FIG. 6 is a sectional view along line VI-VI of FIG. 5.

As shown in FIGS. 3 and 4, each male snap-fit 12 and each female snap-fit 13 are disposed on rib 11 located at the same peak side of the first peak side 14 and the second peak side 15. For example, in the present embodiment, each male snap-fit 12 and each female snap-fit 13 are both disposed on the first peak side 14, and only when both male snap-fit 12 and female snap-fit 13 are located at the same peak side, they can be smoothly jointed as shown in FIG. 6.

Figure 2:
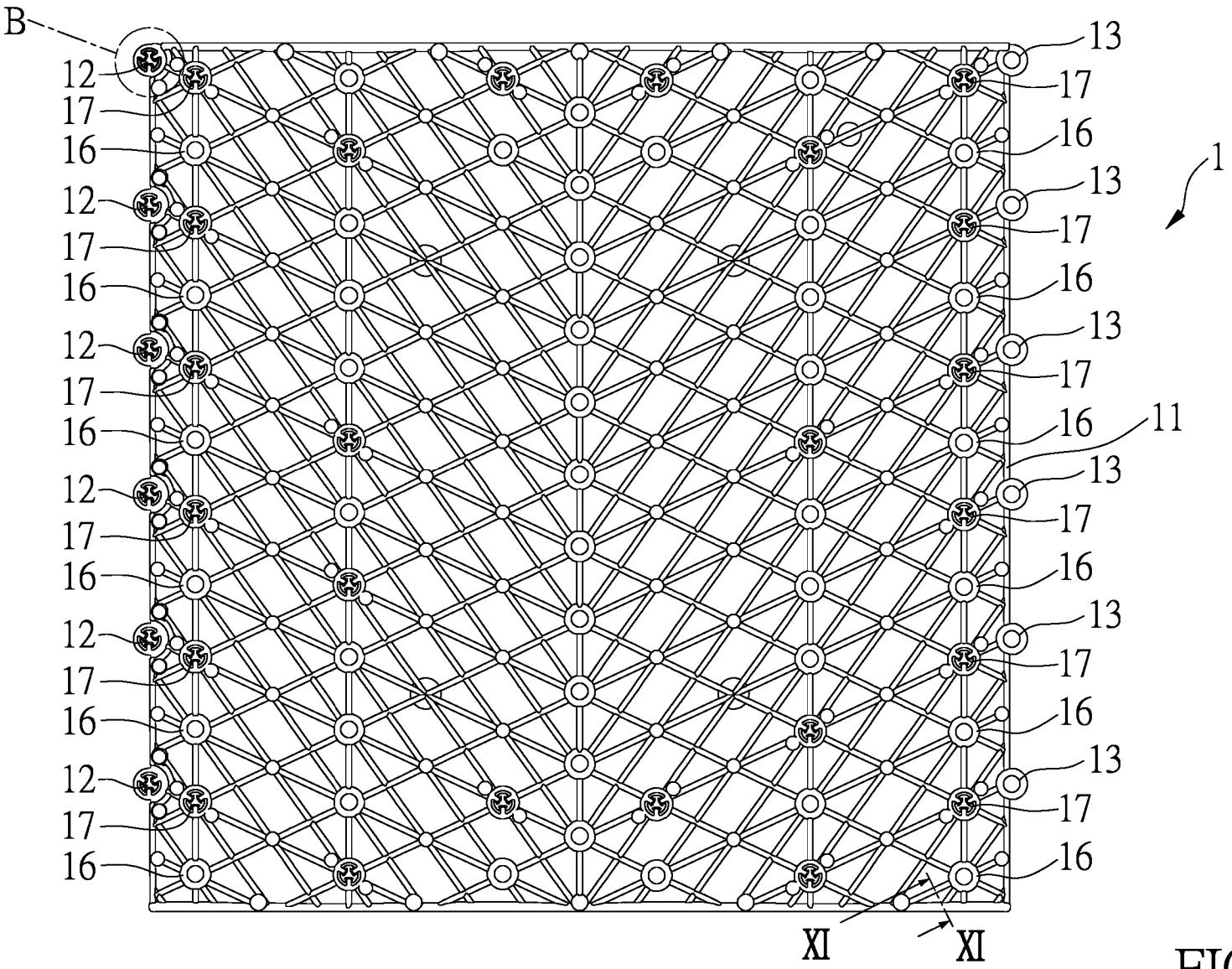
FIG. 2 is a plan view of the present invention.

As shown in FIG. 2, it can be clearly observed from the diagram that each rib 11 is respectively arranged in a triangle and a rectangle pattern to form grids for the mesh configuration, which effectively enhances the cooling performance and reduces the susceptibility to fouling.

Figure 11:
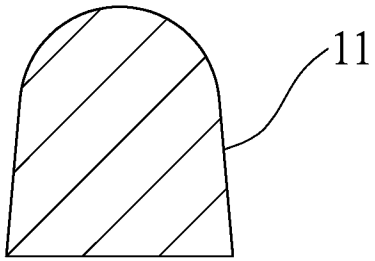
FIG. 11 is a sectional view along line XII-XII of FIG. 2.

As shown in FIG. 11, each rib 11 is in a semi-elliptical (or approximate) shape, which is capable of significantly improving heat dissipation performance and reducing susceptibility to fouling.

Figure 7:
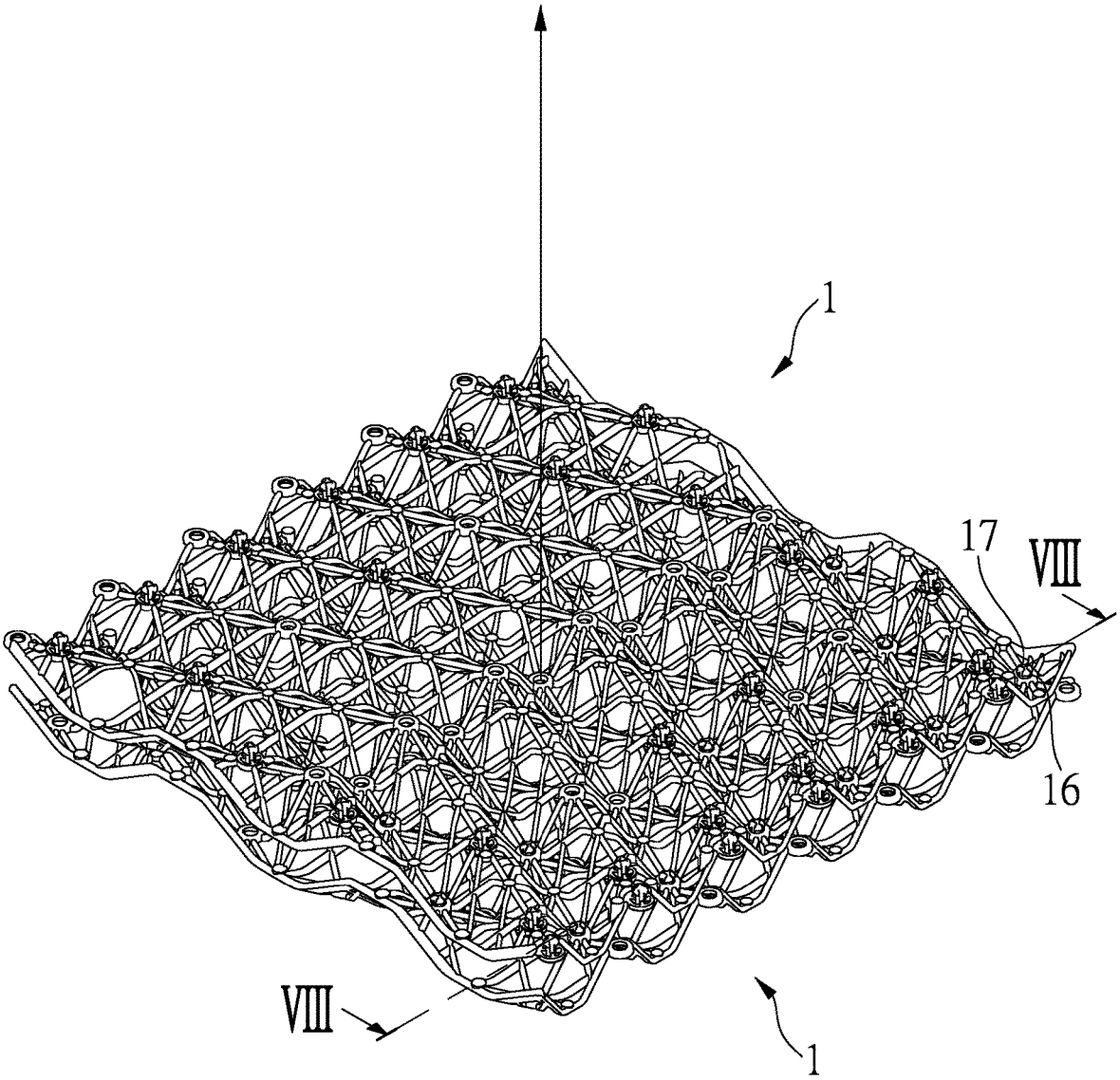
FIG. 7 is a schematic diagram of multiple stackable and connected heat dissipation meshes.
Figure 8:
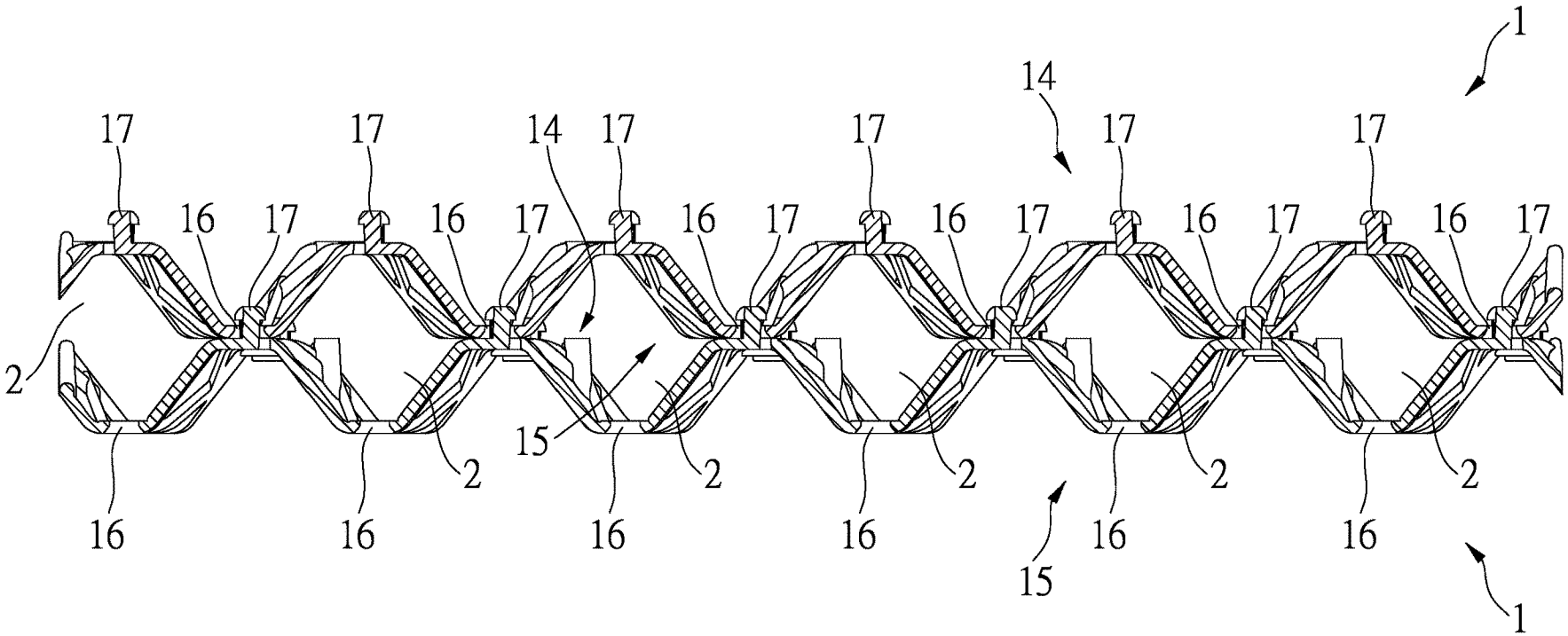
FIG. 8 is a sectional view along line VIII-VIII of FIG. 7.
Figure 10:
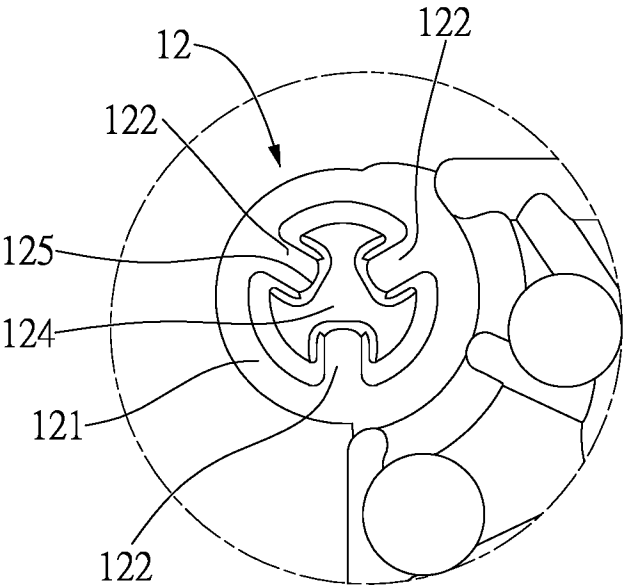
FIG. 10 is a partial enlarged view of part B in FIG. 2.
Figure 9:
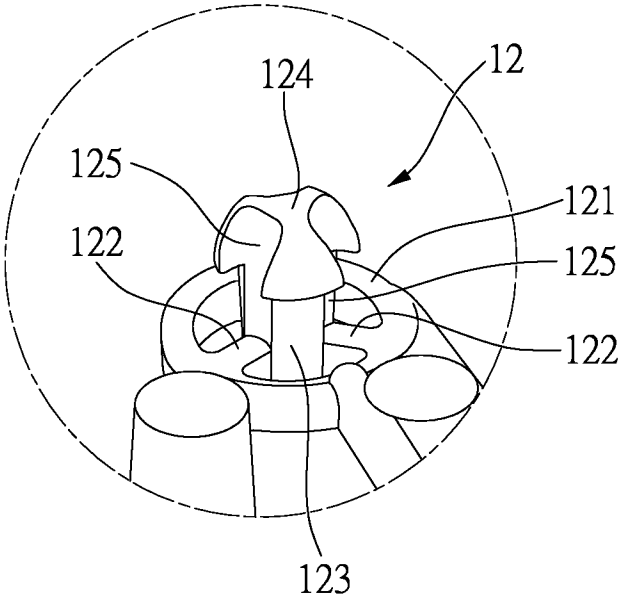
FIG. 9 is a partial enlarged view of part A in FIG. 1.

Furthermore, as shown in FIGS. 1, 7, and 8, the heat dissipation mesh 1 has a plurality of stackable female snap-fits 16 and stackable male snap-fits 17 distributed on each rib except for those on both sides, and each stackable male snap-fit 16 and each stackable female snap-fit 17 can be snap-fitted to each other, and the stacking can continue upward in the direction indicated by the arrow in FIG. 7. As cooling towers may not all have cylindrical shapes, it is necessary to provide a stacking connection structure so that the present invention can be applied to cooling towers of different shapes.

Each stackable male snap-fit 17 is provided on one of the ribs located at the first peak side 14 or the second peak side 15, and each stackable female snap-fit 16 is provided on another one of the ribs located at the first peak side 14 or the second peak side 15. For example, in the present embodiment, each stackable male snap-fit 17 is located on the first peak side 14, and each stackable female snap-fit 16 is located on the second peak side 15. This design allows each stackable male snap-fit 17 to be located on a different peak side than each stackable female snap-fit 16, so that when stacking, one of the heat dissipation meshes 1 only needs to be horizontally rotated 180 degrees to be successfully stackable. Moreover, as shown in FIG. 8, each space 2 is formed, thereby effectively generating stacking height. Combining the aforementioned content, the ribs 11 of the present invention are arranged in a triangular or rectangular (or approximate) pattern to form various grids in a trapezoidal waveform. When multiple heat dissipation meshes 1 are stackable, the ribs 11 form structures with various angles, and the spaces 2 formed between them increase the retention time of water by flowing through the aforementioned angles. The aforementioned structure also produces a good ventilation effect at multiple angles. When the fan of the cooling tower draws air, it can flow through the various spaces, greatly increasing the contact opportunity between air and water and achieving better heat dissipation efficiency.

Furthermore, the material used for the heat dissipation mesh 1 includes properties of non-stickiness and antibacterial.

Furthermore, each side male snap-fit 12 includes a circular portion 121, a plurality of claw ribs 122 extending from the circular portion 121 to a center, a snap body 123 connected with one end of each of the plurality of claw ribs 122, and a snap head 124 connected with one end of the snap body 123, and the width diameter of the snap head 124 is greater than that of the connected snap body 123; a plurality of grooves 125 penetrating each connected snap head 124 and snap body 123, each claw rib 122 partially located in the corresponding groove 125, and each side female snap-fit 13 has a circular ring shape. This structure enables stable interlocking between the side male snap-fit 12 and the side female snap-fit 13, and the design of the claw ribs 122 abutting against the grooves 125 can prevent the snap body 123 from becoming distorted due to external forces.

Furthermore, the structure of the stackable female snap-fit 16 is the same as that of the side female snap-fit 13, and the structure of the stackable male snap-fit 17 is the same as that of the side male snap-fit 12.

What is claim is:

1. A heat dissipation mesh for a cooling tower, comprising at least two heat dissipation meshes, each heat dissipation mesh including a plurality of ribs arranged in a mesh configuration and wherein each rib on one end of each heat dissipation mesh has a plurality of side male snap-fits and each rib on another end of each heat dissipation mesh has a plurality of side female snap-fits, wherein each rib is arranged in a trapezoidal waveform, each of the at least two heat dissipation meshes has a first peak side and a second peak side, each side male snap-fit and each side female snap-fit are disposed on the rib located at the same peak side of the first peak side and the second peak side, the side male snap-fits of one of the at least two heat dissipation meshes are snap-fitted to the side female snap-fits of another one of the at least two heat dissipation meshes.

2. The heat dissipation mesh for the cooling tower according to claim 1, wherein each rib is respectively arranged in a triangle and a rectangle pattern to form grids for the mesh configuration.

3. The heat dissipation mesh for the cooling tower according to claim 1, wherein each rib is in a semi-elliptical shape.

4. The heat dissipation mesh for the cooling tower according to claim 1, wherein a plurality of stackable female snap-fits and male snap-fits are distributed on each rib except for the ribs on both sides of each of the at least two heat dissipation meshes, and each stackable male snap-fit and each stackable female snap-fit are snap-fitted to each other.

5. The heat dissipation mesh for the cooling tower according to claim 4, wherein each rib is arranged in a trapezoidal waveform.

6. The heat dissipation mesh for the cooling tower according to claim 5, wherein each stackable male snap-fit is provided on one of the ribs located at the first peak side or the second peak side, and each stackable female snap-fit is provided on another one of the ribs located at the first peak side or the second peak side.

7. The heat dissipation mesh for the cooling tower according to claim 1, wherein the material used for each of the at least two heat dissipation meshes includes properties of non-stickiness and antibacterial.

8. The heat dissipation mesh for the cooling tower according to claim 1, wherein each side male snap-fit includes:

a circular portion;

a plurality of claw ribs extending from the circular portion to a center;

a snap body connected with one end of each of the plurality of the claw ribs; and a snap head connected with one end of the snap body, and the width diameter of the snap head is greater than that of the connected snap body;

a plurality of grooves penetrating each connected snap head and snap body, each claw rib partially located in the corresponding groove, and each side female snap-fit has a circular ring shape.

9. A heat dissipation mesh for a cooling tower, comprising at least two heat dissipation meshes, each heat dissipation mesh including a plurality of ribs arranged in a mesh configuration;

wherein each rib on one end of each heat dissipation mesh has a plurality of side male snap-fits and each rib on another end of the heat dissipation mesh has a plurality of side female snap-fits, such that the side male snap-fits of one of the at least two heat dissipation meshes are snap-fitted to the side female snap-fits of another one of the at least two heat dissipation meshes, and wherein each side male snap-fit includes a circular portion, a plurality of claw ribs extending from the circular portion to a center, a snap body connected with one end of each of the plurality of the claw ribs, and a snap head connected with one end of the snap body, a width diameter of the snap head is greater than that of the connected snap body, a plurality of grooves penetrate each connected snap head and snap body, each claw rib is partially located in the corresponding groove, each side female snap-fit has a circular ring shape.

* * * * *